US008443993B1

(12) United States Patent
Desselle

(10) Patent No.: US 8,443,993 B1
(45) Date of Patent: May 21, 2013

(54) BOTTLE CAP ASSEMBLY WITH MEANS TO RETAIN A DETACHED CAP PORTION

(76) Inventor: Michael C. Desselle, Cypress, TX (US)

( * ) Notice: Subject to any disclaimer, the term of this patent is extended or adjusted under 35 U.S.C. 154(b) by 282 days.

(21) Appl. No.: 12/877,926

(22) Filed: Sep. 8, 2010

Related U.S. Application Data

(63) Continuation of application No. 61/240,972, filed on Sep. 9, 2009.

(51) Int. Cl.
*B65D 55/16* (2006.01)

(52) U.S. Cl.
USPC ..... 215/306; 215/235; 215/317; 215/354; 215/355; 220/230; 220/288; 220/375; 24/302

(58) Field of Classification Search
USPC ..... 220/230, 288, 375; 215/235, 306, 215/317, 354, 355; 24/302
See application file for complete search history.

(56) References Cited

U.S. PATENT DOCUMENTS 2,704,100 A * 3/1955 Freeman ..... 383/96
3,306,483 A * 2/1967 Bellafiore ..... 215/306
3,402,844 A 9/1968 Chin
3,994,409 A * 11/1976 Nightengale, Jr. ..... 215/256
5,244,106 A 9/1993 Takacs
2006/0249471 A1 11/2006 Leposavic et al.
2008/0142466 A1 6/2008 Balitski
2009/0134112 A1 5/2009 Reeves
2009/0152231 A1 6/2009 Hanson
2009/0301990 A1 * 12/2009 Cresswell et al. ..... 215/344

* cited by examiner

*Primary Examiner* — Anthony Stashick
*Assistant Examiner* — Elizabeth Volz
(74) *Attorney, Agent, or Firm* — Andrew W. Chu; Craft Chu PLLC

(57) ABSTRACT

The present invention is a bottle cap assembly comprising an anchor for attachment to a bottle and a cap portion removably attached to the anchor. The anchor has a first connector, and the cap portion has a second connector. The second connector removably engages the first connector, when the cap portion detaches from the anchor, and extends around the circumference of the cap portion, so that the cap portion can be attached to the first connector in any orientation. The first connector can also be mounted on a tab extending down from the anchor. The first and second connectors can be male and female connectors, respectively. Alternatively, the first and second connectors can be compatible magnets. A retaining member can also be used to permanently attach the cap portion and anchor member to reduce the risk of loss when the first and second connectors are being engaged.

12 Claims, 5 Drawing Sheets

BOTTLE CAP ASSEMBLY WITH MEANS TO RETAIN A DETACHED CAP PORTION

RELATED U.S. APPLICATIONS

The present application claims priority under U.S. Code Section 119(e) from a provisional patent application, U.S. Patent Application No. 61/240,972, filed on 9 Sep. 2009 and entitled "BOTTLE CAP ASSEMBLY WITH MEANS TO RETAIN A DETACHED CAP PORTION".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a bottle cap assembly for bottles required to alternate between being open and closed during use, such as a small water bottle. More particular, the present invention relates to a bottle cap assembly with a retaining means for a detached cap portion of the bottle cap assembly. Additionally, the present invention also relates to the method of using the bottle cap assembly.

2. Description of Related Art Including Information Disclosed Under 37 CFR 1.97 and 37 CFR 1.98

Bottled beverages and other bottle-type containers commonly use a disposable bottle cap assembly. The assembly seals the contents in the bottle until the bottle is opened for use. The bottle cap assembly includes a cap portion and an anchor portion. The cap portion unscrews from the bottle and detaches from the anchor portion, when the bottle is initially opened for use. To re-seal the bottle, the cap portion threadedly engages the top of the bottle again. The cap portion cannot re-attach to the anchor member. The bottle can be sealed and unsealed by the cap portion throughout the use of bottle, for example, until the entire liquid beverage is consumed.

As shown, in FIG. 1, the prior art bottle assembly 1 includes an anchor means 2 and a cap portion 3. The cap portion 3 unscrews from the threaded portion 5 of the bottle 4, and there is nothing to hold the cap portion 3. The cap portion 3 may be lost and easily separated from the anchor means 2 locked onto the bottle 4.

With the loose cap portion, the repeated sealing and unsealing increase the risk of misplacing the cap portion. The bottle cannot be sealed and unsealed without the cap portion. Another consequence of the loose cap portion is environmental pollution. The separation of the bottle and the cap portion is that the cap portion is less likely to be recycled with the bottle. Unlike the attached anchor member, the cap portion is no longer associated with the bottle. More people recycle the bottles after use, and the cap portion is forgotten. The number of discarded bottle caps can be a burden on the environment. Unlike pop-top cans with the pop tab attached to the can, the entire bottle assembly is not easily or routinely recycled.

In the past, various patents have been issued in the field of bottle caps. For example, U.S. Pat. No. 2,704,100 (the '100 patent), issued on Mar. 15, 1955 to Freeman teaches a bottle cap that has a means for storage and attachment of the cap when it is removed. The cap has a female connector, shown as reference numeral 20 in FIGS. 1 and 2, as an insert hole. A male connector, represented by reference numeral 15 as a protruding peg, extends outwardly from a position adjacent the top of the bottle.

U.S. Patent Publication No. 2009/0134112, published on May 28, 2009 to Reeves similarly discloses a baby bottle with a cap that is attachable to the side of the bottle. Referring to FIG. 1, it can be seen that the bottle has a male connector represented by reference numeral 51 extending outwardly from a side of the bottle. The bottle cap has a female connector, represented by reference numeral 52 extending from a top thereof. FIGS. 2A through 2D show various alternative embodiments of the male and female connectors.

U.S. Patent Publication No. 2009/0152231, published on Jun. 18, 2009 to Hanson also describes a bottle with a bottle cap holder positioned adjacent the top of the bottle. Female connectors, various embodiments of which are shown in FIGS. 1A through 1F, extend outwardly from the side of the bottle. The bottom, open portion of the bottle cap is received in the female connectors. The bottle cap may have a lip extending outwardly therefrom to ensure secure placement within the female connectors, as shown in FIG. 2A. The bottle cap is completely detached from the bottle for re-association with the female connector.

U.S. Pat. No. 3,306,483, issued on Feb. 28, 1967 to Bellafiore, describes an attachable captive cap device, wherein the cap is captured by an elastic tab with one end attached to the bottle. The cap is suspended from the tab for maintaining the cap with the bottle. The attachment to the cap includes a male connector on the top of the cap and a female connector on an end of the elastic tab. Similarly, the male-female attachment is again disclosed by the present invention.

U.S. Pat. No. 3,402,844, issued on Sep. 24, 1968 to Chin and U.S. Pat. No. 5,244,106, issued on Sep. 14, 1993 to Takacs, each disclose bottle assemblies to retain the removable cap portion. In both patents, the bottle has a cap-shaped cavity on the bottom of the bottle, so that the cap can be stored in this cavity when the bottle is opened for consumption of the contents.

Similarly, U.S. Publication No. 2008/0142466, published on Jun. 19, 2006, for Balitski and U.S. Publication No. 2006/0249471, published on Nov. 9, 2006 for Leposavic et al., each teach bottle assemblies to retain the removable cap portion in a cavity on the side of the bottle. The cavities are used to store the cap portions, when the bottle is open. The cavity is embedded into the shape of the bottle, and the cap portions are removably housed within such cavities.

It is an object of the present invention to provide a bottle cap assembly that retains a detached cap portion.

It is an object of the present invention to provide a bottle cap assembly that maintains the cap portion with the bottle during sealing and un-sealing of the bottle.

It is another object of the present invention to provide a removable and replaceable cap portion.

These and other objects and advantages of the present invention will become apparent from a reading of the attached specification and appended claims.

SUMMARY OF THE INVENTION

The present invention is a bottle cap assembly comprising an anchor means for attachment to a bottle and a cap portion removably attached to the anchor means. The anchor means has a first connecting means on an outer periphery thereof, and the cap portion has a second connecting means on a top surface of the cap portion. The second connecting means removably engages the first connecting means when the cap portion detaches from the anchor means. The second connecting means extends around the circumference of the cap portion, so that the cap portion can be attached to the first connecting means in any orientation.

In a preferred embodiment, the first connecting means is a male connector, and the second connecting means is a female connector. The anchor means is a ring member, locked onto the bottle by known means, such as inverted angle pins or a bottleneck ridge with a diameter greater than the ring member. The male connector is a protrusion having a stem and block member. The stem attached to the anchor means, and the block member has opposing indentations on an outer surface thereof. The female connector is a continuous groove on a top surface of the cap portion with an interior ridge so as to engage indentations of the block member. The female connector can engage the male connector in any orientation of the cap portion. The cap portion can slide the male connector within the groove for flexible positioning as well.

One alternative embodiment mounts the first connecting means on a tab extending downward from the ring member. Such that the connections to the first connecting means are located at the end of the tab instead of on the ring member of the anchor means. For the male and female connector embodiment, the stem of the male connector is attached to the end of the tab instead of extending from the ring member of the anchor means. In another alternative embodiment, the first and second connecting means are complementary magnets. The first connecting means is a single magnet, while the second connecting means is a metallic strip. The cap portion maintains the ability to attach to the anchor member at any orientation. In still another alternative embodiment, there is a retaining means housed in the cap and pivotally connected at both ends to the cap portion and anchor member, respectively.

DETAILED DESCRIPTION OF THE DRAWINGS

Figure 1:
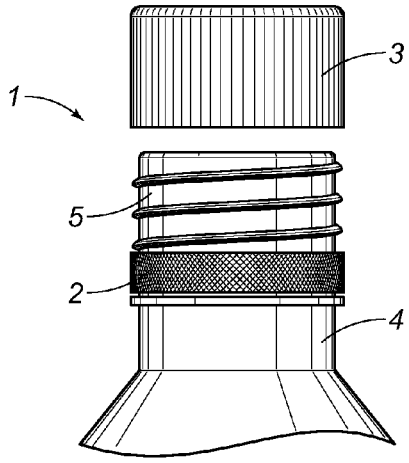
FIG. 1 Prior Art
FIG. 1 is an exploded schematic view of the prior art bottle cap assembly, showing a detached cap portion.
Figure 2:
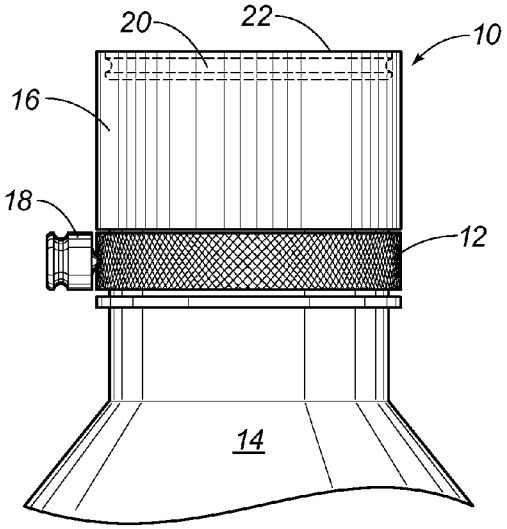
FIGS. 2 and 3 are schematic views of the bottle cap assembly of the present invention, showing the initial configuration and the detached configuration, respectively of the cap portion.
Figure 3:
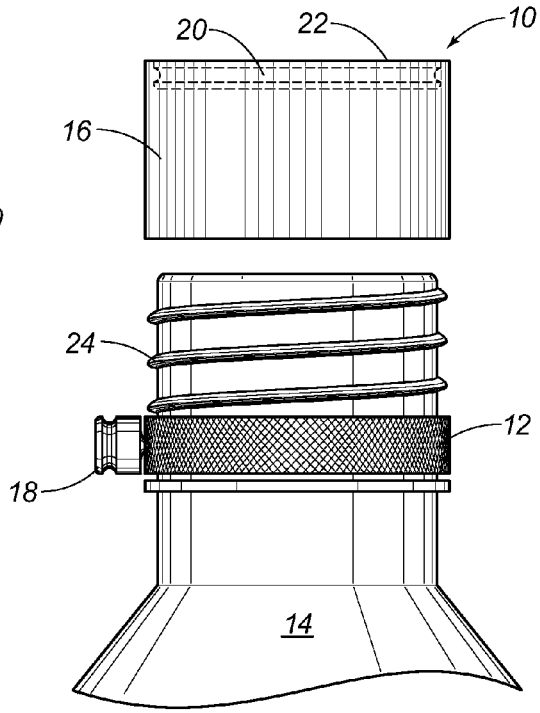

Referring to FIGS. 2-6, the present invention is a bottle cap assembly 10 comprising an anchor means 12 for attachment to a bottle 14, having a first connecting means 18 on an outer periphery thereof, and a cap portion 16 removably attached to the anchor means 12. The cap portion 16 has a second connecting means 20 at a top surface 22 of the cap portion 16. The second connecting means 20 removably engages the first connecting means 18, when the cap portion 16 detaches from the anchor means 12. The attached configuration is shown in FIG. 2, and the detached configuration is shown in FIG. 3.

Figure 4:
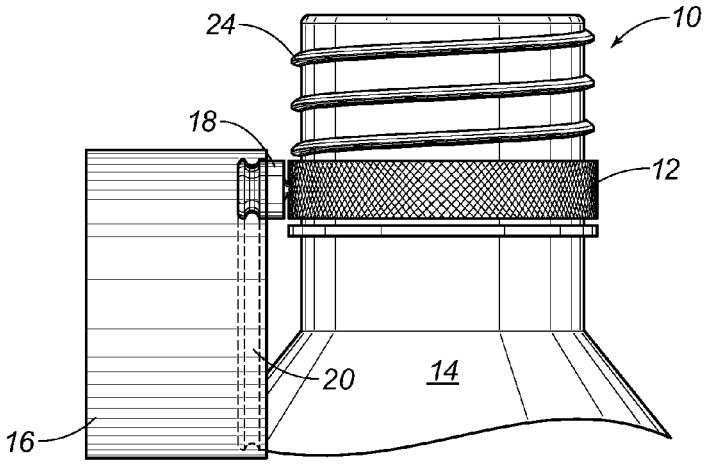
FIG. 4 is a side schematic view of the bottle cap assembly of the present invention, showing the retaining configuration.
Figure 5:
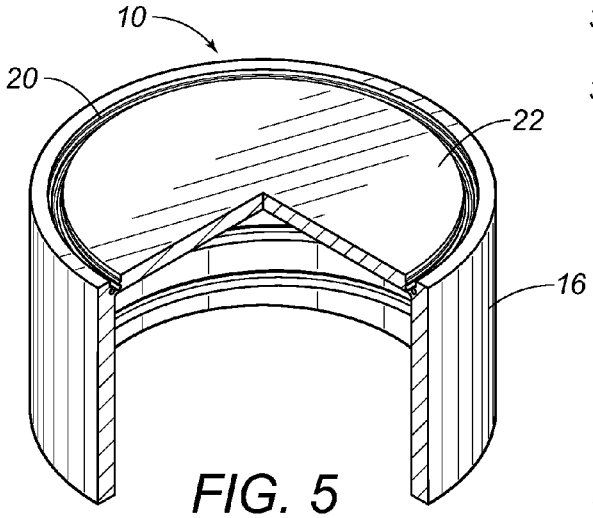
FIG. 5 is a partial cross-sectional view of a top surface of the cap portion of the bottle cap assembly of the present invention.

As shown in the retaining configuration of FIG. 4 and FIG. 5, the second connecting means 20 extends around the circumference of the cap portion 16, so that the cap portion 16 can be attached to the first connecting means 18 in any orientation. The first connecting means 18 can engage the circular groove at any point along the circular groove. The cap portion 16 can be retained on the bottle 14, so that disposal and recycling of the both the cap portion and the bottle are coordinated. Additionally, the bottle 14 can be sealed and re-sealed without losing or misplacing the cap portion 16. The working life of the bottle 14 can be extended by the present invention.

FIGS. 2-6 show the preferred embodiment of the present invention with the first connecting means 18 as a male connector and the second connecting means as a female connector 20. In this embodiment, FIGS. 2-6 show the anchor means 12 as a ring member, locked onto the bottle 14. The locking can be accomplished by known means, such as inverted angle pins, a bottle neck ridge or bottle thread 24 with a diameter greater than the anchor means 12 as a ring member. The anchor means 12 can be friction fit and mounted on the bottle 14 with enough strength to retain the cap portion 16 and resist stresses of regular bottle use.

Figure 6:
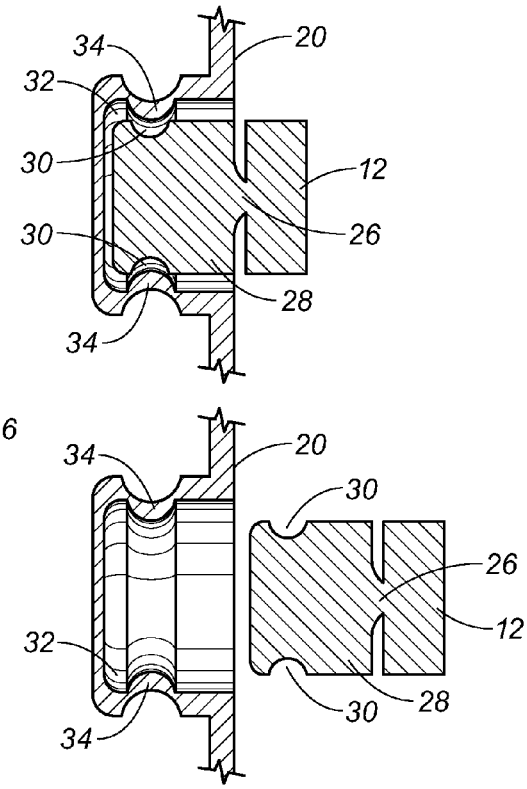
FIG. 6 has two partial cross-sectional views of the attachment between the male connector of the anchor member and the female connector of the cap portion.
Figure 8:
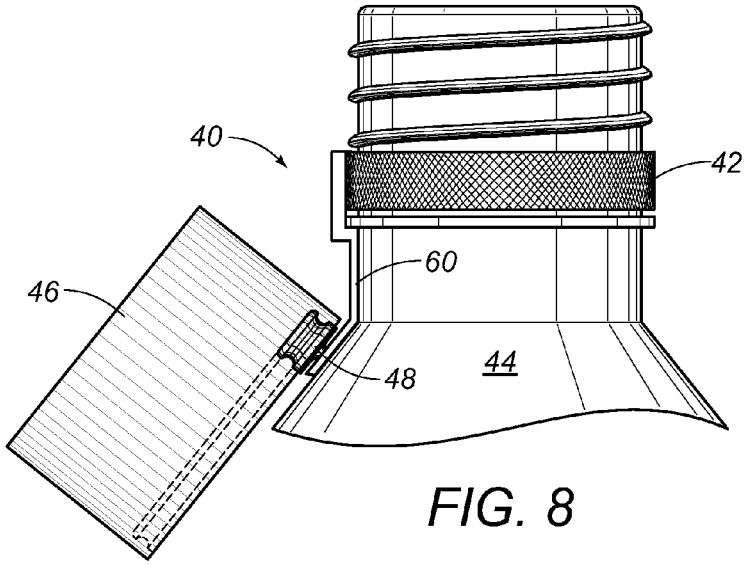
FIGS. 7 and 8 show two schematic views of another embodiment of the present invention with a tab member.

FIG. 6 shows an isolated sectional view of the first connecting means 18 as male connector as a protrusion having a stem 26 and block member 28. The stem 26 attaches to the anchor means 12, and the block member 28 with opposing indentations 30 on an outer surface thereof. The second connecting means 20 as a female connector is a continuous groove 32 around a top surface of the cap portion 16 with interior ridges 34, engaging indentations 30 of the block member 28. The drawings of FIG. 6, show that the second connecting means 20 as a female connector can engage the first connecting means 18 as a male connector in any orientation of the cap portion 16. The first connecting means 18 can engage the circular groove at any point along the groove. The male and female connectors are a preferred embodiment of the present invention.

Figure 7:
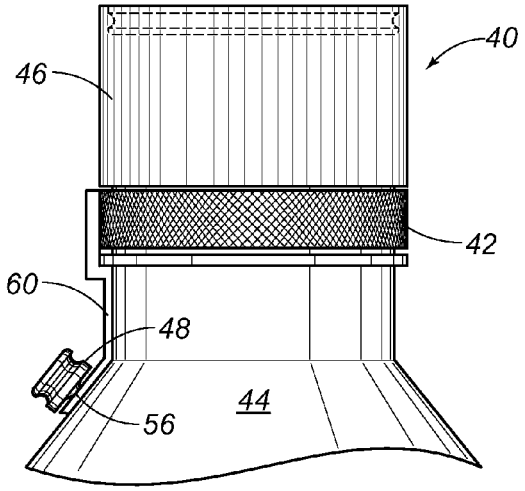

FIG. 7 shows one alternative embodiment of a bottle cap assembly 40 of the present invention, wherein the first connecting means 48 is mounted on a tab 60 extending downward from the anchor means 42 as a ring member. For the male and female connector version, the connections to the first connecting means 48 are located at the end of the tab 60 instead of on the anchor means 42. In particular, the stem 56 of the male connector is attached to the end of the tab 60 instead of extending from the ring member of the anchor means 42. This alternate embodiment moves the retaining position of the cap portion 46 relative to the opening of the bottle so that the contents of the bottle can be dispensed to the user. The tab 60 allows for different size caps to be used with the bottle cap assembly of the present invention.

Figure 9:
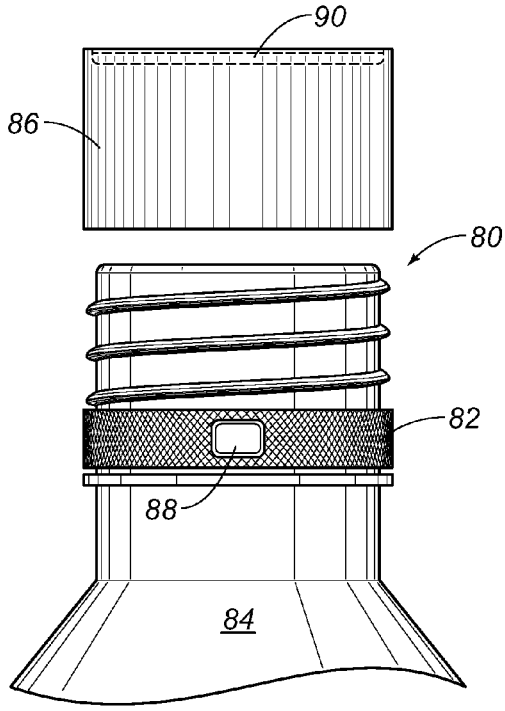
FIG. 9 shows a schematic view of still another embodiment of the present invention with magnets as connectors.

In another alternative embodiment, FIG. 9 shows a detached configuration of the bottle cap assembly 80 of the present invention. The first connecting means 88 and second connecting means 90 are complementary materials that attract and engage magnetically. For example, the first connecting means 88 is a single magnet piece, while the second connecting means is a metallic strip 90 within a top of the cap portion 86. The cap portion 86 maintains the ability to attach to the anchor member 82 at any orientation. Again, the first connecting means 88 can engage the second connecting means at any point along the strip 90 for easy and convenient mounting. This anchor member 82 similarly locks onto the bottle 84 as previously described by known means, including but not limited to friction-fit engagement. The magnets of the first and second connecting means 88 and 90 may also include the tab variation to lower the cap portion 86 from the opening of the bottle 84.

Figure 10:
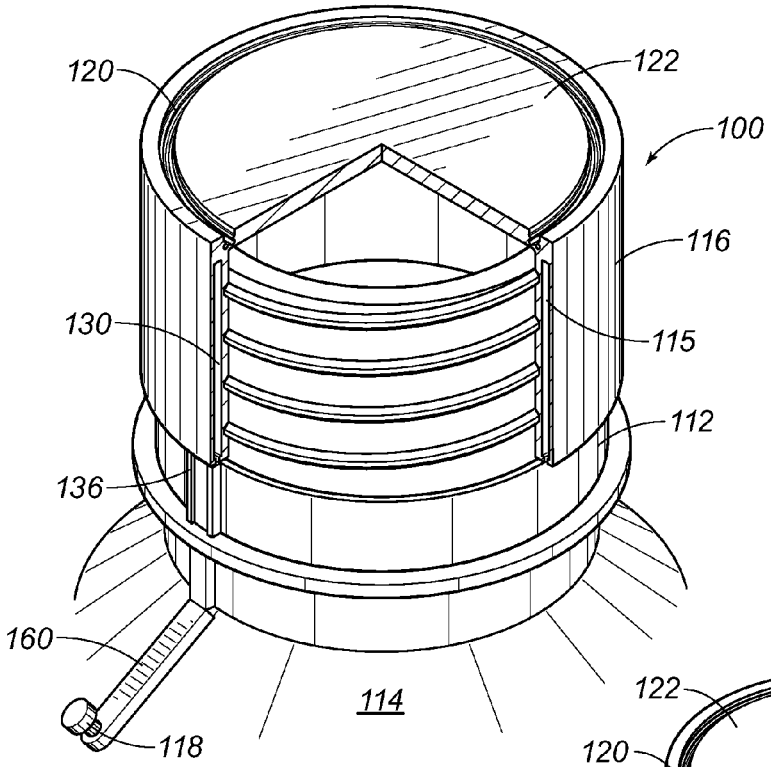
FIGS. 10-12 show partial sectional and schematic views of another embodiment of the present invention with a retaining means between the cap portion and the anchor member.
Figure 11:
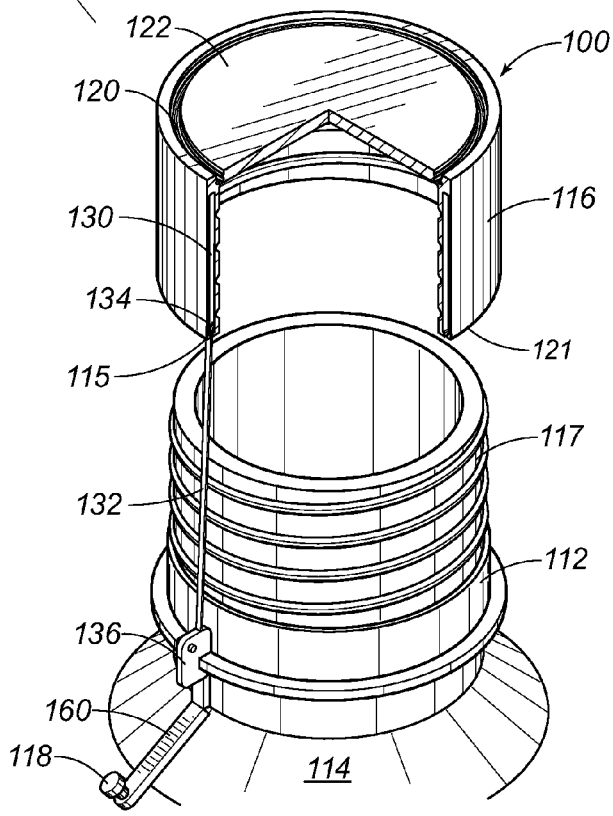
Figure 12:
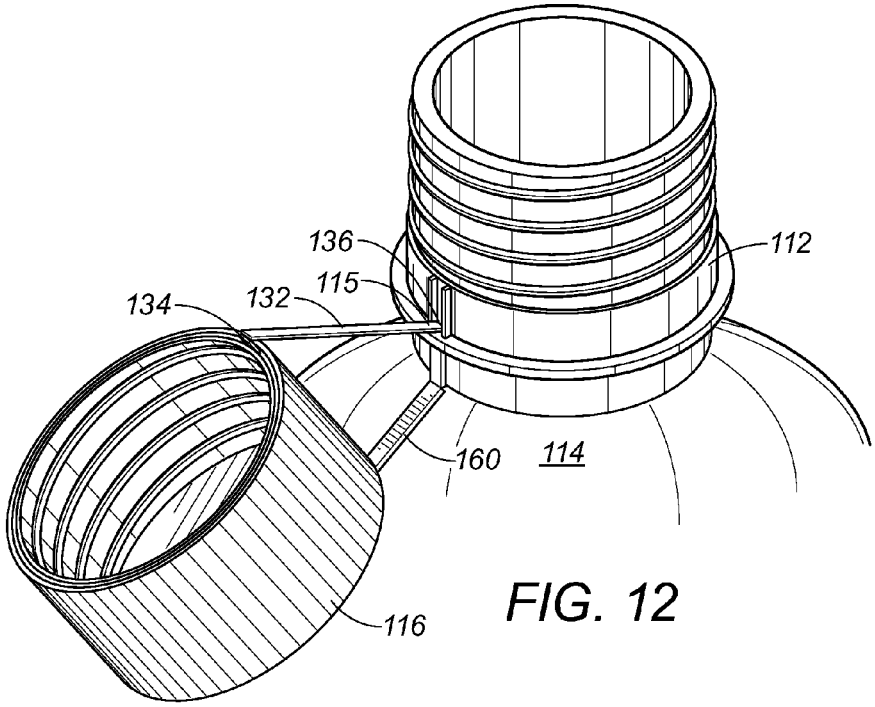

In still another embodiment, FIGS. 10-12 show the bottle cap assembly 100 with a retaining means 115. The bottle cap assembly 100 includes the same anchor means 112 for attachment to a bottle 114, having a first connecting means 118 on an outer periphery thereof, and a cap portion 116 removably attached to the anchor means 112. The cap portion 116 has a second connecting means 120 at a top surface 122 of the cap portion 116. FIGS. 10-12 show an embodiment with the tab 160 extending downward from the anchor means 112.

As shown in FIGS. 10-12, the cap portion 116 is comprised of a retaining sleeve 130 along an entire circumference of the cap portion 116. The retaining sleeve 130 is made integral with the cap portion 116. The retaining means 115 is for permanent attachment of the cap portion 116 and the anchor means 112. The retaining means 115 includes a rod element 132 housed in the retaining sleeve 130, being generally flexible and straight. The rod element 132 extends into the retaining sleeve 130 when the cap portion 116 is sealed onto the bottle 114, both before and after separating from the anchor means 112. The retaining means 115 also includes a locking means 134 to prevent detachment from the retaining sleeve 130 at an end of the rod element 132. Any known attachment, such a friction-fit abutment, can be used to lock the end of the rod element 132 into the retaining sleeve 130. When the cap portion 116 detaches from the anchor means 112, the rod element 132 freely slides within the retaining sleeve 130, such that the cap portion 116 can rotate and turn while remaining attached to the anchor means 112 by the rod element 132.

Figure 13:
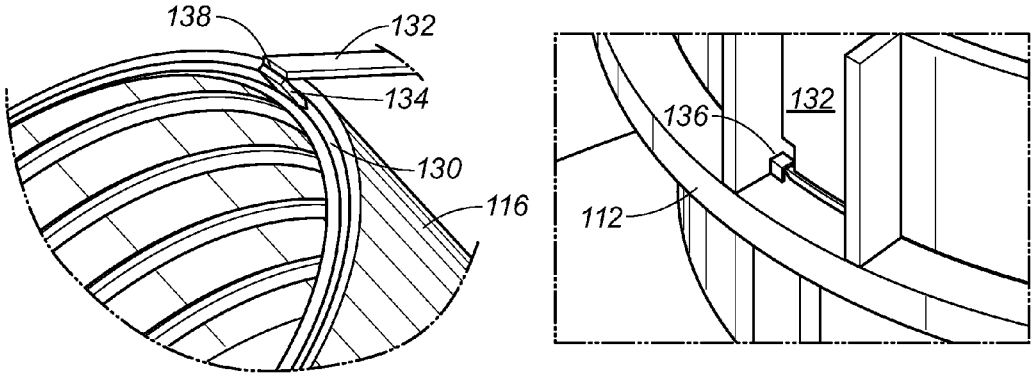
FIG. 13 shows two schematic views of types of hinges for the retaining means of the present invention.

There is also a first hinging means 136 pivotally connected to the anchor means 112. FIGS. 11, 12 and 13 each show different versions of hinging means for this pivotal connection between the retaining means 115 and the anchor means 112. A second hinging means 138 in FIG. 13 pivotally connects between the locking means 134 and the rod element 132. The hinging means 136 and 138 work cooperatively to align the engagement between the first connector 118 and second connector 120, while maintaining permanent attachment between the cap portion 116 and the anchor means 112. This embodiment further reduces the risk of losing or misplacing the cap portion 116 after initially unsealing the bottle 114.

The present invention also includes the method for using the assembly of a cap portion and anchor on a bottle. First, the anchor and a cap portion are attached to the bottle. The bottle has a ridge extending outward from a threaded neck of the bottle, so that the ring member of the anchor is locked in place. The anchor is comprised of a first connector on an outer periphery of the anchor and a ring member with a locking device onto the bottle, and the cap portion is removably attached to the anchor and engageable on the bottle by screw threads. There is a second connector on a top surface of the cap portion. Next, the cap portion detaches from the anchor while releasing a threaded engagement between the cap portion and the bottle. Also, the second connector is aligned to engage the first connector when the cap portion detaches from the anchor. The second connector extends around the top of the cap portion so that the first connector removably attaches to the second connector so as to hold the cap portion to the anchor while the bottle is open. The first connector can engage the second connector along any point along the top of the cap portion.

When the male connector is comprised of a protrusion extending outward from the anchor member and when the female connector on the cap portion comprises a continuous circular groove on a top surface of the cap portion and a plurality of interior ridges so as to engage the protrusion, the step of removably attaching the first connector and the second connector comprises inserting the protrusion within the circular groove. A friction-fit connection is formed between the male connector and the plurality of interior ridges, the cap portion being rotatable and engageable all along the circular groove. In particular, the plurality of interior ridges of the second connector can engage the indentations of the block member of the first connector. The second connector can be lowered and oriented, even if the first connector is on a tab or on the anchor itself.

In an alternative embodiment, the method includes magnetically attaching the first connector to the second connector, during the step of removably attaching. The second connector remains shaped as a continuous ring along a top surface of the cap portion so as to align the cap portion in any orientation.

In another alternative embodiment, when there is a retaining sleeve, rod element, and lock on the cap portion, the method includes extending the rod element between the retaining sleeve and the anchor during the step of detaching, and actuating the rod element so as to allow the step of aligning the first connector and the second connector. The step of actuating may include pivoting the rod element at hinges at both ends thereof. Furthermore, the rod element may be completely detached from the anchor after complete use.

The present invention provides a bottle cap assembly that retains a detached cap portion. The cap portion is stored on the bottle during sealing and un-sealing of the bottle. The risk of losing or misplacing the cap portion is significantly reduced. The ease of opening and closing the bottle is also increased because the user does not have store and search for the cap portion separately. Additionally, the particular cap portion of the present invention can be oriented in any position, while engaging the connector on the anchor to the bottle. The user does not have to carefully examine and align particular structures of the device. As such, fine motor control is not required, and the connection can be fast and efficient. The removable and replaceable cap portion of the present invention with the unique second connector is a significant improvement. Additionally, the retaining means provides a permanent attachment of the cap portion to the anchor means to further reduce the risk of misplacing the cap portion in the process of engaging the first and second connectors.

The foregoing disclosure and description of the invention is illustrative and explanatory thereof. Various changes in the details of the illustrated construction and method can be made without departing from the true spirit of the invention. The present invention should only be limited by the disclosure and the specification. The present invention should only be limited by the following claims and their legal equivalents.

I claim:

1. A bottle cap assembly comprising:

an anchor means for attachment to a bottle, having a first connecting means on an outer periphery of said anchor means; and a cap portion removably attached to said anchor means and engageable on said bottle by screw threads, having a second connecting means on an top surface of said cap portion, said second connecting means removably engaging said first connecting means when said cap portion detaches from said anchor means and extending around the cap portion, said first connecting means being a male connector, said second connecting means being a female connector, wherein said bottle has a ridge extending outward from a threaded neck of said bottle, and wherein said anchor means is comprised of a ring member with a locking means onto said bottle, said locking means being comprised of a plurality of inverted angle pins pointed inward from a perimeter of said ring member, said ring member having a diameter smaller than said ridge, said inverted pins engaging screw threads of said threaded neck so as to lock said anchor means in place.

2. The bottle cap assembly of claim 1, wherein said male connector is a protrusion extending outward from said anchor member.

3. The bottle cap assembly of claim 2, wherein said protrusion is comprised of a stem and block member, said stem being attached to said anchor means, said block member having opposing indentations on a outer surface and a diameter greater than a diameter of said stem.

4. The bottle cap assembly of claim 2, wherein said female connector on said cap portion comprises:

a continuous circular groove on a top surface of said cap portion; and a plurality of interior ridges so as to engage indentations of said protrusion, said cap being friction fit on said protrusion.

5. A method for assembly of a cap portion on a bottle, according to claim 1, the method comprising the steps of:

attaching an anchor and a cap portion to said bottle, said bottle having a ridge extending outward from a threaded neck of said bottle, said anchor being comprised of a first connector on an outer periphery of said anchor and a ring member with a locking device onto said bottle, said locking device being comprised of a plurality of inverted angle pins pointed inward from a perimeter of said ring member, said ring member having a diameter smaller than said ridge, said inverted angle pins engaging screw threads of said threaded neck so as to lock said anchor in place, said first connector being a male connector, said cap portion being removably attached to said anchor and engageable on said bottle by screw threads, having a second connector on an top surface of said cap portion, said second connector being a female connector;

detaching said cap portion from said anchor while releasing a threaded engagement between said cap portion and said bottle;

aligning said second connector to engage said first connector when said cap portion detaches from said anchor, the second connector extending around the cap portion; and removably attaching said first connector to said second connector so as to hold said cap portion to said anchor while the bottle is open.

6. The method for assembly of a cap portion on a bottle, according to claim 5, wherein said male connector is comprised of a protrusion extending outward from said anchor member, wherein said female connector on said cap portion comprises:

a continuous circular groove on a top surface of said cap portion; and a plurality of interior ridges so as to engage said protrusion, and wherein the step of removably attaching said first connector and said second connector comprises the steps of:

inserting said protrusion within the circular groove, forming a friction-fit connection between the male connector and said plurality of interior ridges, said cap portion being rotatable and engageable all along the circular groove.

7. The method for assembly of a cap portion on a bottle, according to claim 5, wherein the step of removably attaching said first connector and said second connector comprises the steps of:

magnetically attaching said first connector to said second connector, said second connector being shaped as a continuous ring along a top surface of said cap portion so as to align said cap portion in any orientation.

8. A bottle cap assembly comprising:

an anchor means for attachment to a bottle, having a first connecting means on an outer periphery of said anchor means; and a cap portion removably attached to said anchor means and engageable on said bottle by screw threads, having a second connecting means on an top surface of said cap portion, said second connecting means removably engaging said first connecting means when said cap portion detaches from said anchor means and extending around the cap portion, said first connecting means being a male connector, said second connecting means being a female connector, wherein said male connector is a protrusion extending outward from said anchor member, and wherein said female connector on said cap portion comprises:

a continuous circular groove on a top surface of said cap portion; and a plurality of interior ridges so as to engage indentations of said protrusion, said cap being friction fit on said protrusion.

9. The bottle cap assembly of claim 8, wherein said bottle has a ridge extending outward from a threaded neck of said bottle, and wherein said anchor means is comprised of a ring member with a locking means onto said bottle, said locking means being comprised of a plurality of inverted angle pins pointed inward from a perimeter of said ring member, said ring member having a diameter smaller than said ridge, said inverted pins engaging screw threads of said threaded neck so as to lock said anchor means in place.

10. The bottle cap assembly of claim 8, wherein said protrusion is comprised of a stem and block member, said stem being attached to said anchor means, said block member having opposing indentations on a outer surface and a diameter greater than a diameter of said stem.

11. A method for assembly of a cap portion on a bottle, according to claim 8, the method comprising the steps of:

attaching an anchor and a cap portion to said bottle, said bottle having a ridge extending outward from a threaded neck of said bottle, said anchor being comprised of a first connector on an outer periphery of said anchor and a ring member with a locking device onto said bottle, said locking device being comprised of a plurality of inverted angle pins pointed inward from a perimeter of said ring member, said ring member having a diameter smaller than said ridge, said inverted angle pins engaging screw threads of said threaded neck so as to lock said anchor in place, said first connector being a male connector, said cap portion being removably attached to said anchor and engageable on said bottle by screw threads, having a second connector on an top surface of said cap portion, said second connector being a female connector;

detaching said cap portion from said anchor while releasing a threaded engagement between said cap portion and said bottle;

aligning said second connector to engage said first connector when said cap portion detaches from said anchor, the second connector extending around the cap portion; and removably attaching said first connector to said second connector so as to hold said cap portion to said anchor while the bottle is open, wherein said male connector is comprised of a protrusion extending outward from said anchor member, wherein said female connector on said cap portion comprises:

a continuous circular groove on a top surface of said cap portion; and a plurality of interior ridges so as to engage said protrusion, and wherein the step of removably attaching said first connector and said second connector comprises the steps of:

inserting said protrusion within the circular groove, forming a friction-fit connection between the male connector and said plurality of interior ridges, said cap portion being rotatable and engageable all along the circular groove.

12. The method for assembly of a cap portion on a bottle, according to claim 11, wherein the step of removably attaching said first connector and said second connector comprises the steps of:

magnetically attaching said first connector to said second connector, said second connector being shaped as a continuous ring along a top surface of said cap portion so as to align said cap portion in any orientation.

* * * * *